US005645343A

United States Patent [19]

Rinehimer

[11] Patent Number: 5,645,343

[45] Date of Patent: Jul. 8, 1997

[54] LIGHT-STRING HOLDER

[76] Inventor: John C. Rinehimer, 9289 N. Morning Glory Rd., Paradise Valley, Ariz. 85253

[21] Appl. No.: 713,947

[22] Filed: Sep. 13, 1996

[51] Int. Cl.[6] ..... F21P 1/00

[52] U.S. Cl. ..... 362/252; 362/238; 362/249; 362/396; 362/806

[58] Field of Search ..... 362/238, 239, 362/249, 250, 252, 396, 806, 809

[56] References Cited

U.S. PATENT DOCUMENTS

| | | | |
|---|---|---|---|
| 2,903,820 | 9/1959 | Bodell | 362/809 X |
| 4,769,749 | 9/1988 | Felski | 362/252 X |

*Primary Examiner*—Stephen F. Husar
*Attorney, Agent, or Firm*—Meschkow & Gresham, P.L.C.

[57] ABSTRACT

A light-string holder (20) has two hubs (38) with a plurality of receptacles (40). One of the hubs (38) attaches to an external suspension device (24). The light-string holder (20) has a plurality of lamp-cluster holders (34) fabricated from a translucent material. The lamp-cluster holders (34) have a central beam member (58) with two connectors (46) configured to mate with corresponding receptacles (40) on each hub (38), and a tapered straight edge (70) configured to mate with the other tapered straight edges (70) of the other lamp-cluster holders (34), and a peripheral beam member (60) with a plurality of lamp clamps (32) recessed below the peripheral edge (74) of the peripheral beam member (60). Each of the lamp clamps (32) having a C-shaped member (78) comprising a circular arc greater than 180 degrees and of a diameter equal to or less than the diameter of a lamp socket (84), and where both the central beam member (58) and the peripheral beam member (60) have an I-beam cross section and a plurality of holes (68) through the land area (66) of the I-beam.

20 Claims, 5 Drawing Sheets

LIGHT-STRING HOLDER

TECHNICAL FIELD OF THE INVENTION

The present invention pertains to the display of decorative lamps. More specifically, the present invention relates to the display of decorative strings of lamps arranged in a three-dimensional pattern.

BACKGROUND OF THE INVENTION

Many persons desire to display strings of miniature lamps on festive and holiday occasions. Such displays increase the festivity of the occasion and at the same time may provide the person arranging the display a means of expressing his/her creativity and artistry. Many such displays are of such beauty and intricacy that other individuals travel sizable distances for the sole purpose of viewing the displays and appreciating the artistry. Similarly, many businesses use lamp displays as a means of attracting clientele, whether such displays be seasonal or perennial.

One problem often encountered in such displays is an individual's inability to create stable three-dimensional lamp arrangements. Many individuals have the talent to arrange the lamps artistically, but lack the ability to create free-hanging light "sculptures."

Another problem is that those individuals who do have sufficient ability often give little thought to the safety factors involved, making such sculptures of wire, paper, cardboard, etc. Such conductive and flammable materials may present a danger of electrical shock or fire.

A practical problem arises in that an individual may and often does spend considerable time and money in crafting a sculpture by hand. However, the costs of the basic materials of the sculpture, the costs of incidental items (such as clips with which to fasten the lamps to the sculpture) may drive the overall cost well out of budget. These costs, coupled with the actual time of construction, a time perhaps better spent in other ways, may represent an overall loss to the individual or business involved.

Often, the mechanical construction of such sculptures may be of a nature that precludes longevity of use. Little thought may be given to the choice of materials and the methods of construction regarding durability. Paper or cardboard, for example, may fail abruptly during a sudden rain shower or in a moderate breeze. Such a failure might represent a total loss of invested time and moneys.

Likewise, improper construction techniques for the intended location may lead to loss. For example, if the lamps were mounted on the outer surface of a free-hanging sculpture and the sculpture were to be hung close to a wall, a pole, another sculpture, or some other object, a moderate breeze may case the sculpture to strike against the adjacent object with sufficient force to crack or shatter one or more lamps. This would represent a loss and possibly a safety hazard.

Artistically, another problem presents itself in that the materials used for the sculpture may have no light-transmissive properties of their own, causing the sculpture to be mere points of light in space. Skeletal materials such as wire, for example, may created a points-of-light sculpture. While such a sculpture may admittedly have its own charm, the desired effect inherent in the intrinsic shape or design of the sculpture may well be lost to the viewer at all but an optimum viewing angle. By contrast, paper and other similar materials are opaque or semi-opaque, and may create an occultation problem. Again the desired effect may be reduced to an optimum viewing angle.

Another practical problem exists in the storage and transport of the sculptures. By the very three-dimensional nature of the shapes that give the sculptures their beauty, they may require a disproportionate volume of space for their storage or transport. As a result, many such sculptures with potentially long periods of use may have to be discarded, with the resultant requirement that they be created anew for subsequent occasions. Similarly, the excessive space required may often prohibit storage of very many sculptures, creating a serious problem when differing collections of sculptures are desired for differing occasions, such as spheres or trees for Christmas, hearts for Valentines Day, pumpkins for Halloween, etc. Furthermore, a serious transport problem may exist when such displays are to be repetitively used at differing locations. The high volume of the displays may require the use of multiple vehicles or a larger vehicle, with an increase of transport time or cost. This problem might be especially critical were the sculptures to be used commercially, for example as decorations for outdoor weddings.

What is needed is a three-dimensional light sculpture in varying shapes that is esthetically pleasing, prefabricated, safe, easy to assemble or disassemble, and requires minimal storage space.

SUMMARY OF THE INVENTION

Accordingly, it is an advantage of the present invention that it is an improved light-string holder.

Another advantage of the present invention is that it is designed to be stored disassembled in a compact space.

Yet another advantage of the present invention is that it has translucent members providing an enhanced appearance.

Still another advantage of the present invention is that it holds the individual lamps in such a manner as to protect those lamps from breakage.

The above and other advantages of the present invention may be achieved, in one form, by a light-string holder having two hubs and a number of lamp-cluster holders designed to engage receptacles on those hubs.

BRIEF DESCRIPTION OF THE FIGURES

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
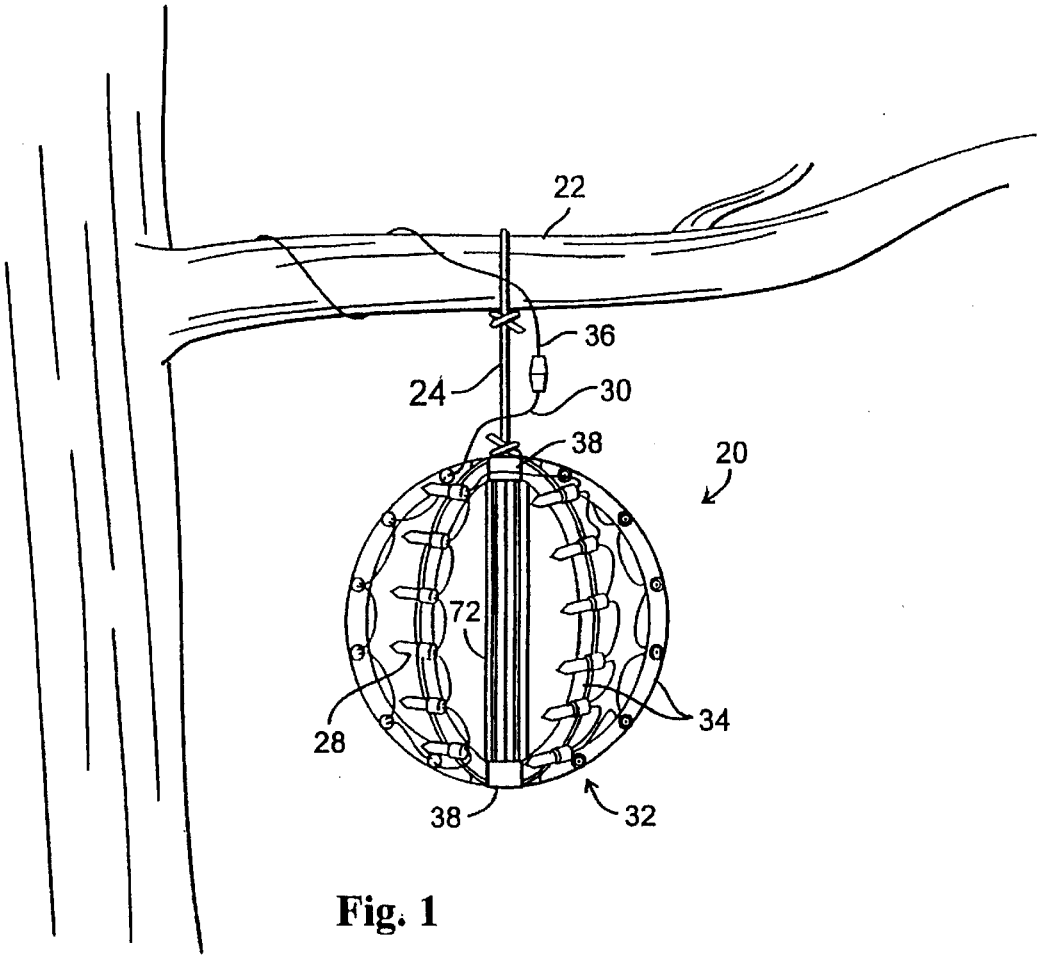
FIG. 1 shows a side view of a spherical embodiment of a light-string holder in use.

FIG. 1 shows a side view of a spherical embodiment of a light-string holder 20 in typical use. In this depiction, light-string holder 20 is shown suspended from a tree branch 22 by means of a cord 24 or other suspension device attached to a suspension bar 26 (see FIG. 4). In actual practice, light-string holder 20 may be suspended from any reasonable platform.

While in use, each lamp assembly 28 of a light string 30 is mounted in a lamp clamp 32. In a preferred embodiment, individual lamp-cluster holders 34 of light-string holder 20 would be fabricated of a translucent material. Light entering lamp-cluster holders 34 reflects and refracts internally (i. e., the light-pipe effect). This characteristic, coupled with the translucency of the material, causes a marked luminescence. The entire light-string holder 20 and light string 30 are transformed into a light sculpture of the intended shape: in this embodiment, a sphere of light. An external extension cord 36 is used to connect light-string 30 to an electrical source.

Figure 2:
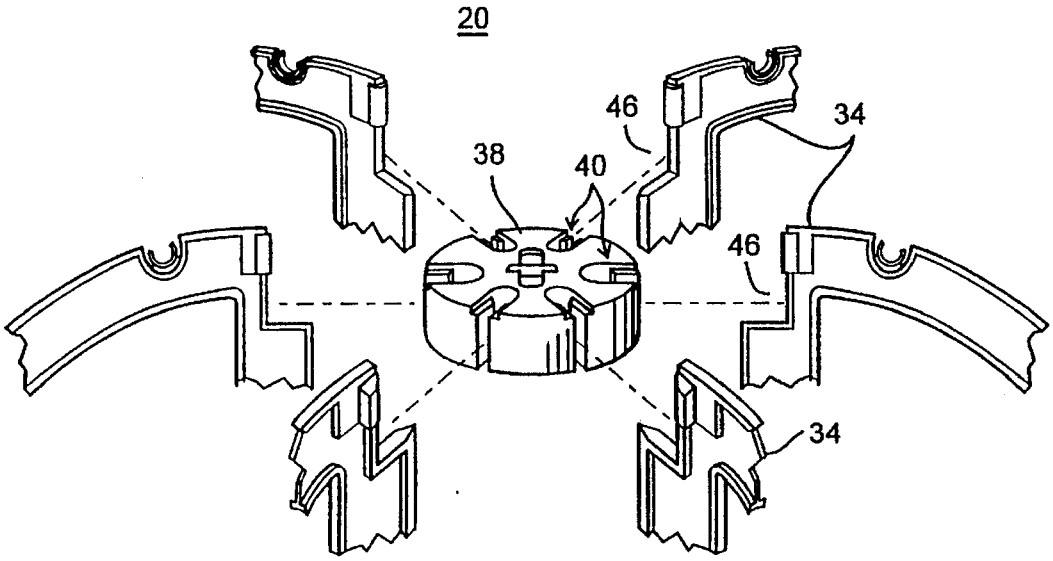
FIG. 2 shows an anisometric exploded view of the area of a light-string holder surrounding a hub and attendant lamp-cluster holders.

FIG. 2 shows an anisometric exploded view of the area of light-string holder 20 surrounding a hub 38 with six receptacles 40 and six attendant lamp-cluster holders 34, depicting the relationship between them. Similarly, FIG. 3 shows an anisometric exploded detail view of a single receptacle 40 and its attendant lamp-cluster holder 34.

Figure 3:
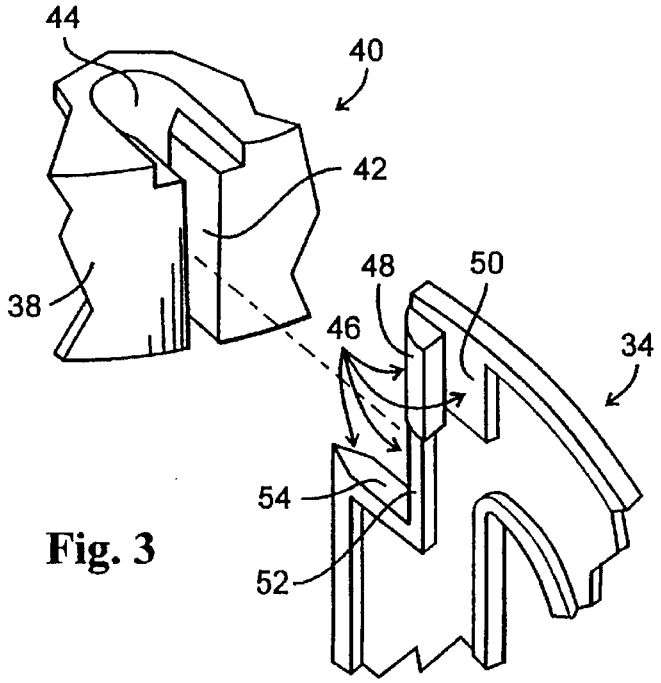
FIG. 3 shows an anisometric exploded detail view of a hub receptacle and a lamp-cluster holder connector.

As can be seen in FIGS. 2 and 3, a receptacle 40 comprises a radially-extending slot 42 and a recessed keyway 44. The corresponding portion of a lamp-cluster holder 34 is a connector 46, including a key 48, a pad 50, a throat 52, and a landing 54. When engaged, key 48 is completely inserted into keyway 44, with the sides of radially-extending slot 42 in contact with the sides of pad 50.

Engagement is achieved in the following manner. As may be understood from viewing FIG. 3, the bottom of hub 38 is positioned in contact with landing 54. Throat 52 is then inserted fully into radially-extending slot 42 by moving lamp-cluster holder 34 towards hub 38. Next, hub 38 and lamp-cluster holder 34 are moved in opposite directions axially until key 48 has been inserted fully into keyway 44. After this action has been performed, key 48 should be inside keyway 44 in contact with a bottom 45 of keyway 44 (see FIG. 5). At this point, the sides of radially-extending slot 42 are in contact with the sides of pad 50. Engagement is then complete for hub 38 and lamp-cluster holder 34 in question. The user then repeats this action for the other lamp-cluster holders 34 attendant upon this hub 38, then repeats it again for lamp-cluster holders 34 and the other hub 38 of light-string holder 20.

Figure 4:
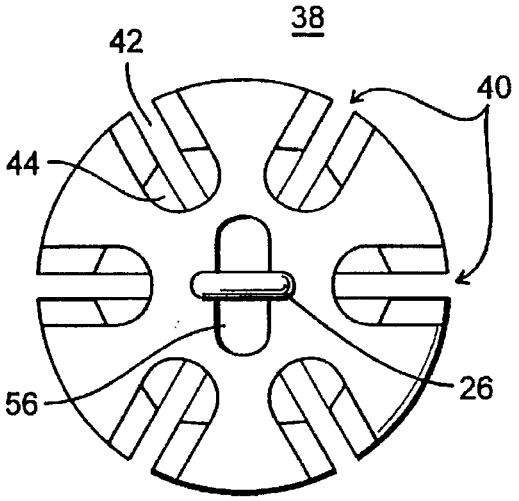
FIG. 4 shows a top view of a hub.
Figure 5:
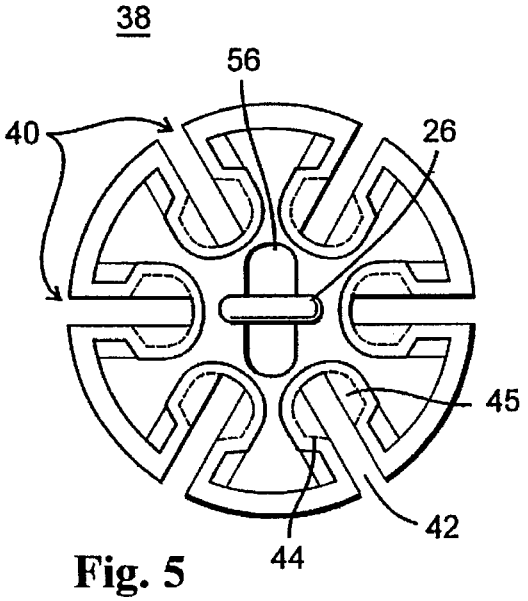
FIG. 5 shows a bottom view of a hub.

FIGS. 4 and 5 show a top view and a bottom view, respectively, of hub 38 for an embodiment of light-string holder 20 having six lamp-cluster holders 34 (as shown in FIG. 2). These figures depict six receptacles 40, each of which has its own radially-extending slot 42 and keyway 44. It may be seen from FIGS. 4 and 5 that radially-extending slots 42 pass completely through hub 38 from top to bottom, while keyways 44 do not. Keyways 44 terminate at keyway bottom 45. This allows throat 52 of lamp-cluster holder 34 (shown in FIG. 3) to enter radially-extending slot 42 by sliding lamp-cluster holder 34 towards the center of hub 38 as far as it will go. Key 48 of lamp-cluster holder 34 (also shown in FIG. 3) can then be fully inserted into keyway 44 by sliding lamp-cluster holder 34 towards the bottom of hub 38 as far as it will go.

While FIGS. 4 and 5 depict hub 38 as having six receptacles 40 for attachment of lamp-cluster holders 34, those skilled in the art will note that other numbers of receptacles 40 may be used. Indeed, in some embodiments a number other that six may be preferred.

Also depicted in FIGS. 4 and 5 is a structure for attachment to an external suspension device. In the embodiment shown, a suspension bar 26 intersects a central opening 56 in hub 38. Light-string holder 20 may be suspended by attaching cord 24 or other external suspension device to suspension bar 26. Those skilled in the art may readily incorporate other suspension structures, such as a hook, an eye, or even a simple hole or pair of holes.

The ability of hubs 38 and lamp-cluster holder 34 to easily interconnect allows light-string holder 20 to be stored or transported disassembled in a flat box, yet still be assembled and made ready for use in a few minutes. Likewise, it may then be quickly disassembled and returned to a flat box for storage or transport once the need for its use has passed.

Figure 6:
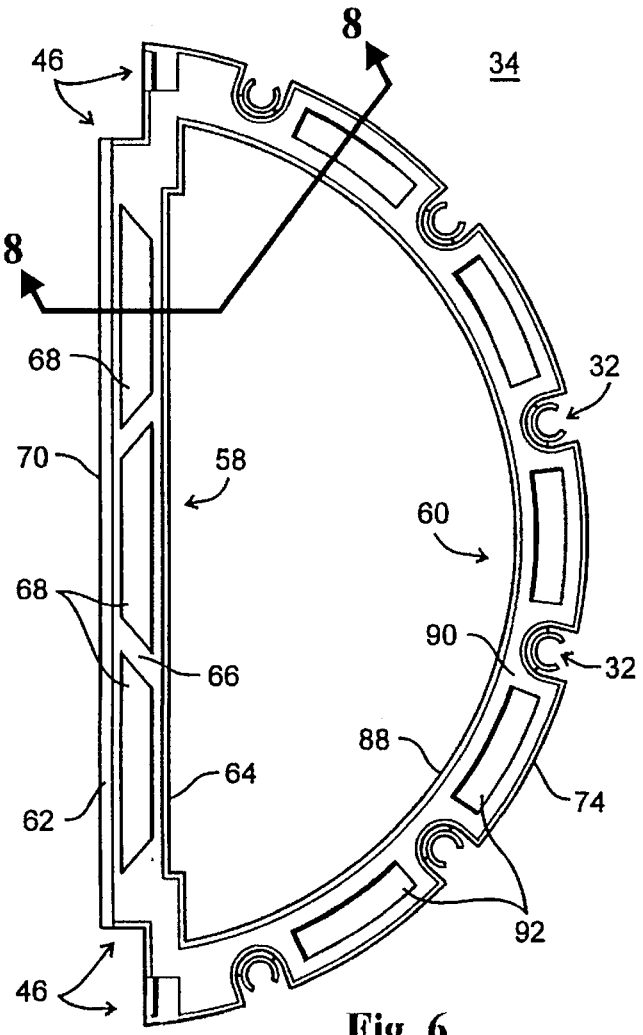
FIG. 6 shows a side view of a lamp-cluster holder for a spherical embodiment.
Figure 9:
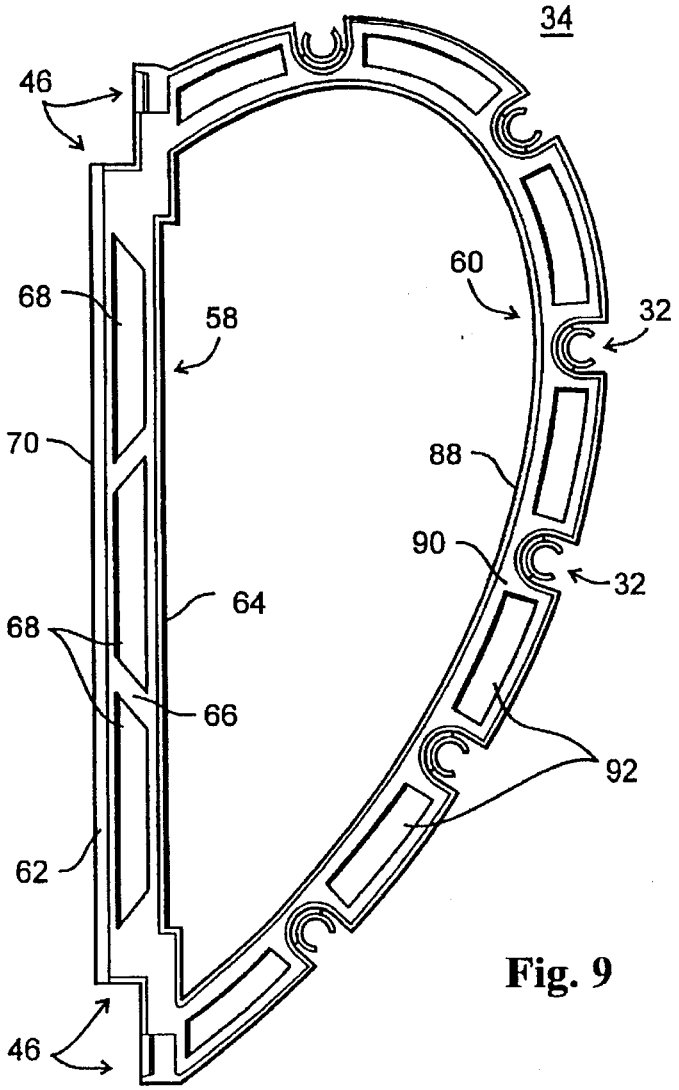
FIG. 9 shows a side view of a lamp-cluster holder for a heart-shaped embodiment.

FIGS. 6 and 9 show side views of different embodiments of lamp-cluster holder 34. FIG. 6 shows a spherical embodiment of light-string holder 20, and FIG. 9 shows a heart-shaped embodiment. Both figures depict a central beam member 58 and a peripheral beam member 60, which taken together compose lamp-cluster holder 34.

Figure 8:
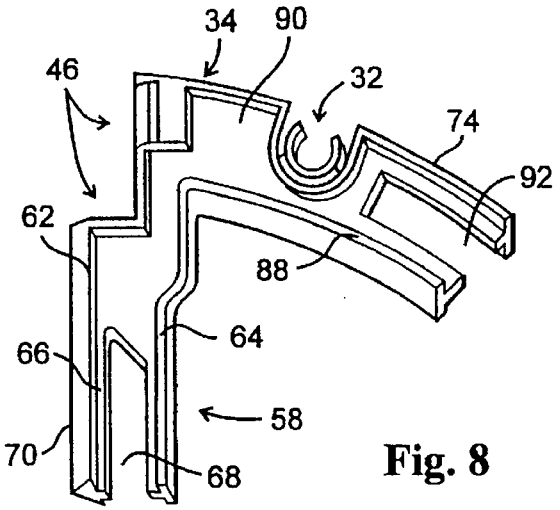
FIG. 8 shows an anisometric detail view of a cut-off portion of a lamp-cluster holder depicting the I-beam construction.

FIGS. 6 and 9, plus FIG. 8 for detail, show that central beam member 58 includes an outer edge 62, an inner edge 64, a land area 66, two connectors 46, and holes 68 through land area 66. Outer edge 62, inner edge 64, and land area 66 taken together give central beam member 58 its cross-sectional shape, which is that of an I-beam. In this structure, outer edge 62 and inner edge 64 each have a designated thickness, and the thickness of land area 66 is less than the thickness of either outer edge 62 or inner edge 64. This cross-sectional shape is desirable as it provides for a maximum of strength and rigidity at a minimum of material. The I-beam shape can be seen most clearly in FIG. 8.

Figure 7:
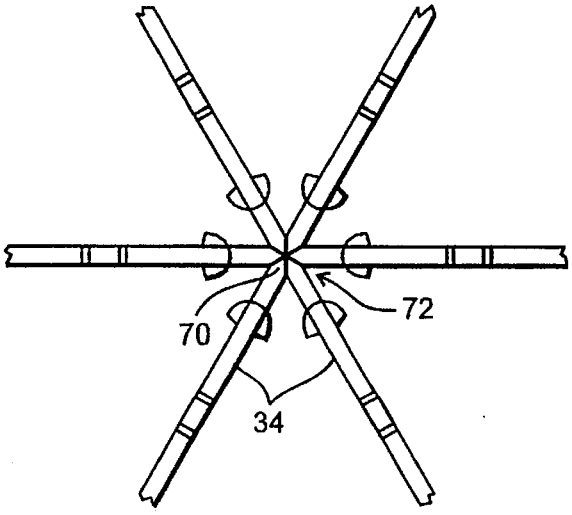
FIG. 7 shows a top view of six joined lamp-cluster holders with a hub removed.

Outer edge 62 of central beam member 58 has a tapered straight edge 70 (see FIG. 8). Tapered straight edge 70 is angled in such a manner that when light-string holder 20 is fully assembled the tapered straight edges 70 of all lamp-cluster holders 34 abut. This abutment creates a central beam assembly 72 (see FIG. 1) with great strength and rigidity. FIG. 7 shows this abutment by providing an axial view of light-string holder 20 with one of the hubs 38 rendered invisible: that is, one of hubs 38 is missing, but lamp-cluster holders 34 are in place as though the missing hub 38 were there.

While the previous paragraph discusses the virtues of an embodiment with central beam members 58, those skilled in the art may readily discern that central beam members 58 are not intrinsically required for construction, and many differing embodiments may be produced where central beam members 58 are omitted.

Looking again to FIGS. 6, 8, and 9, peripheral beam member 60 comprises a peripheral edge 74, an inner edge 88, a land area 90, lamp clamps 32, and holes 92 through land area 90. Peripheral edge 74, inner edge 88, and land area 90 taken together form an I-beam shape and structure. In this structure, peripheral edge 74 and inner edge 88 each have a designated thickness, and the thickness of land area 90 is less than the thickness of either peripheral edge 74 or inner edge 88.

Holes 92 shown passing through land areas 90 of peripheral beam member 60 in FIGS. 6, 8, and 9 serve three functions, as do holes 68 shown passing through land areas 66 of central beam member 58. First, they add a pleasing sparkle to light-string holder 20 (see FIG. 1) by providing places where the light passing internally through lamp-cluster holder 34 may reflect and refract outward. Second, they decrease the sway of light-string holder 20 in the breeze. Third, they reduce the amount of material required for lamp-cluster holder 34. Those skilled in the art will appreciate that lamp-cluster holders 34 may be produced without either holes 68 or holes 92 and still be functional.

Those skilled in the art will also appreciate that any three dimensional shape may be used for peripheral beam members 60: spheres, hearts, pumpkins, prolate or oblate spheroids, etc. Lamp-cluster holders 34 with peripheral beam members 60 of differing shapes may be used in a single light-string holder 20 where an asymmetrical shape is desired.

Likewise, though not specifically depicted in the figures, lamp-cluster holders 34 may be of any size. Those shown assume a light string 30 with thirty-six lamps, but light strings 30 of other sizes or even multiple light strings 30 may be used.

Figure 10:
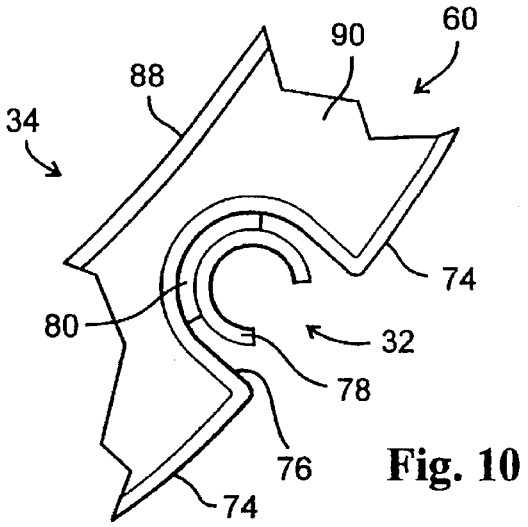
FIG. 10 shows a side detail view of a lamp clamp.
Figure 11:
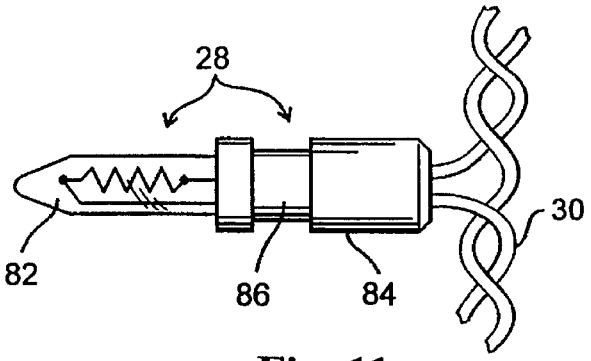
FIG. 11 shows a side detail view of a lamp assembly.
Figure 12:
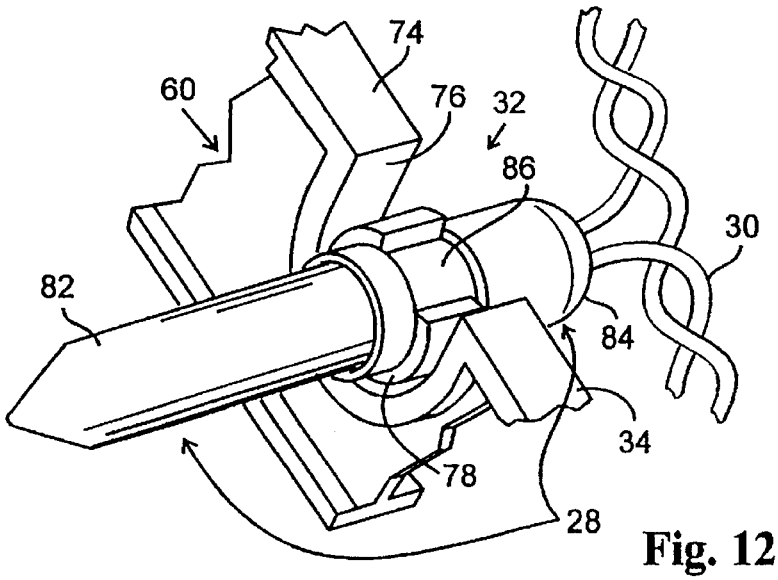
FIG. 12 shows an anisometric detail view of a lamp assembly mounted in a lamp clamp.

FIGS. 10, 11, and 12 show details of a lamp clamp 32, lamp assembly 28, and lamp assembly 28 mounted in lamp clamp 32, respectively. Each lamp assembly 28 is recessed into light-string holder 20 (see FIG. 1) by recessing each individual lamp clamp 32 below peripheral edge 74 of lamp-cluster holder 34 (see FIGS. 6, 8, 9, and 10).

Each lamp clamp 32 resides within an indentation 76 in peripheral edge 74 of lamp-cluster holder 34. Indentation 76 is sufficient so that lamp assembly 28, once mounted, will reside well inside peripheral edge 74. Within indentation 76 resides a C-shaped member 78 (which actually holds a mounted lamp assembly 28) and a clamp land area 80 connecting C-shaped member 78 to peripheral beam member 60 (see FIG. 10).

Each lamp assembly 28 comprises a lamp bulb 82 and a lamp socket 84. Lamp assembly 28 depicted in FIG. 11 shows lamp socket 84 with a circumferential groove 86. C-shaped member 78 of lamp clamp 32 engages circumferential groove 86 when lamp assembly 28 is mounted. While circumferential groove 86 is desirable, it is not required and other lamp socket designs may be used.

To mount lamp assembly 28 into lamp clamp 32, a user snaps lamp socket 84 into C-shaped member 78 of lamp clamp 32 as shown in FIG. 12.

In a two-dimension embodiment, a light-string holder 20 may be constructed such that it has a single lamp-cluster holder 34 whose peripheral beam member 60 forms a closed loop. The periphery of this closed peripheral beam member 60 would contain lamp clamps 32 at selected intervals. A hole 92 through the land area 90 at a strategic location may be used to attach such a light-string holder 20 to an external suspension device.

Indeed, those skilled in the art may readily see that such a two-dimensional light-string holder 20 may be of any shape, with lamp clamps 32 on the inside edge as well as the outside edge of the peripheral beam member 60, which itself may vary in breadth to extremes, allowing a "lace" light-string holder 20 to be created, if desired.

In summary, the current invention is an improved light-string holder 20. It is readily assembled and disassembled, allowing it to be stored in a compact space. The translucency and construction of lamp-cluster holders 34 add a luminescence and sparkle to light string holder 20 and provide an enhanced appearance. The placement and construction of lamp clamps 32 is such that lamp assemblies 28 are positioned so as to provide an improvement in durability and safety.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A light-string holder comprising:

a first hub having a plurality of receptacles;

a second hub having a plurality of receptacles; and a plurality of lamp-cluster holders, each of said lamp-cluster holders designed to mate with one of said receptacles of said first hub and one of said receptacles of said second hub.

2. A light-string holder as claimed in claim 1 wherein one of said hubs includes means for attachment to an external suspension device.

3. A light-string holder as claimed in claim 2 wherein said attachment means comprises:

a central opening; and a suspension bar transecting said central opening for attachment to said external suspension device, said suspension bar being centrally located on said hub.

4. A light-string holder as claimed in claim 1 wherein each of said receptacles is configured to mate with one of said lamp-cluster holders, each of said lamp-cluster holders has a peripheral beam member having a predetermined thickness, and each of said receptacles comprises:

a radially-extending slot of a width greater than said predetermined thickness of said peripheral beam member, said radially-extending slot passing completely through said hub; and a keyway of a greater width than said radially-extending slot, said keyway passing partially through said hub.

5. A light-string holder as claimed in claim 1 for holding a light string having a plurality of lamp assemblies, wherein each of said receptacles is configured to mate with one of said lamp-cluster holders, and each of said lamp-cluster holders comprises a peripheral beam member having:

a first connector at a first end thereof configured to engage one of said receptacles on said first hub;

a second connector at a second end thereof configured to engage one of said receptacles on said second hub;

a predetermined thickness; and a plurality of lamp clamps configured to engage said lamp assemblies.

6. A light-string holder as claimed in claim 5 wherein:

each of said receptacles comprises a radially-extending slot passing through said hub and of a width greater than said predetermined thickness of said peripheral beam member and a keyway passing partially through said hub, of a predetermined shape, and of a width greater than said width of said radially-extending slot; and each of said connectors on said peripheral beam member comprises a key of a shape conformal to said predetermined shape of said keyway, and a thickness greater than said width of said radially-extending slot.

7. A light-string holder as claimed in claim 5 wherein:

said peripheral beam member has an I-shaped cross section having a peripheral edge, an inner edge, and a land area;

said peripheral edge has a thickness;

said inner edge has a thickness; and said land area is less thick than said thickness of said peripheral edge and said thickness of said inner edge.

8. A light-string holder as claimed in claim 7 wherein said peripheral beam member has a plurality of holes passing through said land area.

9. A light-string holder as claimed in claim 5 wherein said peripheral beam member has a peripheral edge, and wherein each of said lamp clamps is recessed into said peripheral beam member from said peripheral edge.

10. A light-string holder as claimed in claim 5 wherein each of said lamp assemblies of said light string comprises a lamp bulb and a lamp socket for said lamp bulb, said lamp socket having a predetermined diameter and wherein each of said lamp clamps:

has a C-shaped member comprising a circular arc greater than 0 degrees and of a diameter equal to or less than said predetermined diameter of said lamp socket; and has a clamp land area joining said C-shaped member to said peripheral beam member.

11. A light-string holder as claimed in claim 5 wherein each of said lamp cluster holders comprises a central beam member.

12. A light-string holder as claimed in claim 11 wherein said central beam member has a tapered straight edge which, when a plurality of said lamp-cluster holders are engaged in said first and second hubs, engages said tapered straight edges of other lamp-cluster holders.

13. A light-string holder as claimed in claim 1 wherein said lamp-cluster holders are fabricated from a translucent material.

14. A light-string holder as claimed in claim 13 wherein said translucent material is polypropylene.

15. A light-string holder as claimed in claim 1 further comprising a light string having a plurality of lamp assemblies.

16. A light-string holder as claimed in claim 15 wherein:

each of said lamp assemblies comprises a lamp bulb and a lamp socket;

each of said lamp-cluster holders comprises a peripheral beam member;

each of said peripheral beam members comprises a plurality of lamp clamps;

each of said lamp clamps has a C-shaped member of a predetermined diameter and thickness and a clamp land area joining said C-shaped member to said peripheral beam member; and each of said lamp sockets has a circumferential groove of a diameter equal to or greater than said predetermined diameter and thickness of said C-shaped member of said lamp clamps.

17. A light-string holder for holding a light string having a plurality of lamp assemblies, said light string holder comprising:

a plurality of lamp-cluster holders, each of said lamp-cluster holders comprising a peripheral beam member having a first connector at a first end thereof, a second connector at a second end thereof, a predetermined thickness, and containing a plurality of lamp clamps, each of which has a C-shaped member;

a first hub having a plurality of receptacles configured to mate with said first connector; and a second hub having a plurality of receptacles configured to mate with said second connector.

18. A light-string holder as claimed in claim 17 wherein:

each of said receptacles comprises a radially-extending slot passing through said hub, said radially-extending slot having a width greater than said predetermined thickness of said peripheral beam member, and a keyway passing partially through said hub, said keyway having a predetermined shape and a width greater than said width of said radially-extending slot; and each of said connectors on each of said peripheral beam members has a key of a shape conformal to said predetermined shape of said keyway and a thickness greater than said width of said radially-extending slot and less than said width of said keyway.

19. A light-string holder for holding a light string having a plurality of lamp assemblies where said light-string holder comprises a first hub, a second hub, and a plurality of lamp-cluster holders, wherein:

each of said lamp assemblies of said light string comprises a lamp bulb and a lamp socket for said lamp bulb, said lamp socket having a predetermined diameter;

one of said hubs includes means for attachment to an external suspension device;

each of said lamp-cluster holders is fabricated from a translucent material and comprises a peripheral beam member;

each of said hubs has a plurality of receptacles configured to interlock with said peripheral beam members of said lamp-cluster holders;

each of said peripheral beam members has an I-shaped cross section having a peripheral edge of a predetermined thickness, an inner edge of a predetermined thickness, and a land area less thick than said predetermined thicknesses of said peripheral edge and said inner edge, with a plurality of holes passing through said land area;

each of said peripheral edges of said peripheral beam members comprises a plurality of lamp clamps for said lamp assemblies, wherein each of said lamp clamps is recessed into said peripheral beam member from said peripheral edge; and each of said lamp clamps has a C-shaped member comprising a circular arc greater than 180 degrees and of a diameter equal to or less than said predetermined diameter of said lamp socket, and has a clamp land area joining said C-shaped member to said peripheral beam member.

20. A light-string holder for holding a light string, said light string holder comprising:

a lamp-cluster holder having a peripheral beam member, said peripheral beam member having a peripheral edge;

a plurality of lamp clamps coupled to said peripheral beam member; wherein:

each of said lamp clamps is recessed into said peripheral beam member from said peripheral edge;

each of said lamp clamps has a C-shaped member; and each of said lamp clamps has a clamp land area joining said C-shaped member to said peripheral beam member.

* * * * *